US011853003B2

(12) United States Patent
Zeng et al.

(10) Patent No.: US 11,853,003 B2
(45) Date of Patent: Dec. 26, 2023

(54) POWER RECEIVING UNIT, ROTATING COMPONENT, PROCESS CARTRIDGE, AND ASSEMBLY AND DISASSEMBLY METHODS THEREOF

(71) Applicant: Ninestar Corporation, Zhuhai (CN)

(72) Inventors: Likun Zeng, Zhuhai (CN); Lai Luo, Zhuhai (CN); Qijie Liang, Zhuhai (CN)

(73) Assignee: NINESTAR CORPORATION, Zhuhai (CN)

( * ) Notice: Subject to any disclaimer, the term of this patent is extended or adjusted under 35 U.S.C. 154(b) by 0 days.

(21) Appl. No.: 17/982,483

(22) Filed: Nov. 7, 2022

(65) Prior Publication Data

US 2023/0068392 A1 Mar. 2, 2023

Related U.S. Application Data

(63) Continuation of application No. 17/244,535, filed on Apr. 29, 2021, now Pat. No. 11,513,469, which is a (Continued)

(30) Foreign Application Priority Data

Jun. 30, 2017 (CN) ..... 201720777257.7
Sep. 11, 2017 (CN) ..... 201721157785.9
(Continued)

(51) Int. Cl.
*G03G 15/00* (2006.01)
*G03G 21/18* (2006.01)
*G03G 21/16* (2006.01)

(52) U.S. Cl.
CPC ..... *G03G 21/1871* (2013.01); *G03G 15/80* (2013.01); *G03G 21/1647* (2013.01);
(Continued)

(58) Field of Classification Search
CPC ..... G03G 15/00; G03G 21/1647; G03G 21/1652; G03G 21/1871; G03G 21/80
(Continued)

(56) References Cited

U.S. PATENT DOCUMENTS 9,098,048 B2 8/2015 Huang
9,740,163 B2 8/2017 Hui et al.
(Continued)

FOREIGN PATENT DOCUMENTS

CN 101320230 A 12/2008
CN 201897693 U 7/2011
(Continued)

OTHER PUBLICATIONS

The World Intellectual Property Organization (WIPO) International Search Report for PCT/CN2018/093080 dated Sep. 17, 2018 6 Pages (including translation).
(Continued)

*Primary Examiner* — Hoan H Tran
(74) *Attorney, Agent, or Firm* — ANOVA LAW GROUP PLLC

(57) ABSTRACT

A process cartridge is provided. The process cartridge is detachably mounted in an image formation apparatus configured with a power output unit that is swingable, an outer circumference of the power output unit contains a recessed portion. The process cartridge includes: a power receiving unit, comprising a wheel hub and a power receiving member connected with the wheel hub, the power receiving member being engaged with the power output unit to receive a driving force; where the wheel hub comprises a hollow cylinder portion accommodating the power output unit; where the power receiving member includes a fixing protrusion, the fixing protrusion is engaged with the recessed portion of the power output unit to receive the driving force;
(Continued)

where the power receiving unit further comprises a bias part, the bias part applies a bias force to drive the power output unit to move to engage with the fixing protrusion.

14 Claims, 12 Drawing Sheets

Related U.S. Application Data continuation of application No. 16/679,709, filed on Nov. 11, 2019, now Pat. No. 11,022,937, which is a continuation of application No. PCT/CN2018/093080, filed on Jun. 27, 2018.

(30) Foreign Application Priority Data

| | | |
|---|---|---|
| Jan. 31, 2018 | (CN) | 201820175356.2 |
| Apr. 17, 2018 | (CN) | 201820545129.4 |
| May 23, 2018 | (CN) | 201810503202.6 |

(52) U.S. Cl.
CPC ..... *G03G 21/1652* (2013.01); *G03G 21/1864* (2013.01); *G03G 2221/166* (2013.01); *G03G 2221/1654* (2013.01); *G03G 2221/1657* (2013.01)

(58) Field of Classification Search
USPC ..... 399/90, 111
See application file for complete search history.

(56) References Cited

U.S. PATENT DOCUMENTS

| | | | |
|---|---|---|---|
| 9,964,920 | B2 | 5/2018 | Hu et al. |
| 10,175,607 | B2 | 1/2019 | Fujita et al. |
| 11,022,937 | B2 | 6/2021 | Zeng et al. |
| 2003/0053823 | A1 | 3/2003 | Cho et al. |

FOREIGN PATENT DOCUMENTS

| | | | | |
|---|---|---|---|---|
| CN | 103279023 | A | | 9/2013 |
| CN | 103676561 | A | | 3/2014 |
| CN | 204533437 | U | | 8/2015 |
| EP | 1925992 | A2 | | 5/2008 |
| EP | 2259156 | A2 | | 12/2010 |
| JP | 2004 216591 | | * | 8/2004 |
| JP | 2011154326 | A | | 8/2011 |
| WO | 2016137014 | A1 | | 9/2016 |

OTHER PUBLICATIONS

The European Patent Office (EPO) the Extended European Search Report for 18824753.0 dated May 6, 2020 12 Pages.

* cited by examiner

POWER RECEIVING UNIT, ROTATING COMPONENT, PROCESS CARTRIDGE, AND ASSEMBLY AND DISASSEMBLY METHODS THEREOF

CROSS-REFERENCES TO RELATED APPLICATIONS

This application is a continuation application of U.S. patent application Ser. No. 17/244,535 filed on Apr. 29, 2021, which is a continuation application of U.S. patent application Ser. No. 16/679,709 filed on Nov. 11, 2019, which in turn is a continuation application of PCT Patent Application No. PCT/CN2018/093080, filed on Jun. 27, 2018, which in turn claims the priority of Chinese patent applications No. 201720777257.7, filed on Jun. 30, 2017; No. 201721157785.9, filed on Sep. 11, 2017; No. 201820175356.2, filed on Jan. 31, 2018; No. 201820545129.4, filed on Apr. 17, 2018; and No. 201810503202.6, filed on May 23, 2018, the entirety of all of which is incorporated herein by reference.

FIELD OF THE DISCLOSURE

The present disclosure generally relates to the field of laser printing, and, more particularly, relates to a process cartridge including a power receiving unit and a rotating component, and methods for assembling and disassembling the process cartridge.

BACKGROUND

The present disclosure relates to a process cartridge. The process cartridge may be applied to an image formation apparatus based on an electrostatic printing technique. The image formation apparatus may be any one of a laser image formation apparatus, a LED image formation apparatus, a copying machine, and a fax machine.

The process cartridge may be detachably mounted in the image formation apparatus. A plurality of rotating components may be disposed in parallel along a length direction of the process cartridge. The rotating component may include a photosensitive component having a photosensitive layer for receiving irradiation of laser beam in the image formation apparatus to form an electrostatic latent image. The rotating component may also include a charging component for charging a surface of the photosensitive component to form uniform charge on the surface of the photosensitive component. In addition, the rotating component may include a developing component for transferring developer in the process cartridge to the electrostatic latent image region of the photosensitive component to form a visible developer image. Further, the rotating component may include components, e.g., a wheel hub or a gear, etc., for transmitting power in the process cartridge. Each component in the above-described rotating component may have to produce relative rotation when the process cartridge operates, which may desire to acquire a rotating driving force from the image formation apparatus.

In the prior art, a power receiving unit is often disposed at an axial end of the process cartridge to engage with a power output unit in the image formation apparatus to receive power. The power receiving unit in the process cartridge is set to be directly connected to a rotating component inside the process cartridge, and the rotational driving force is transmitted to any other rotating component through the rotating component. Alternatively, the rotational driving force is transmitted to a gear on a longitudinal end of the process cartridge through the power receiving unit, and then transmitted to any other rotating component inside the process cartridge through the gear.

FIGS. 1*a* and 1*b* illustrate schematic diagrams of a process cartridge for receiving a driving force from an image formation apparatus. Referring to FIGS. 1*a* and 1*b*, the process cartridge 7 includes a rotating component 1 (e.g., a photosensitive component, a developing component, a powder feeding component, etc.). Two ends of the rotating component 1 are rotatably supported on a frame 71 of the process cartridge 7. A power receiving unit 570 is disposed on an end of the rotating component 1. The image formation apparatus is provided with a swingable power output unit 101. After the process cartridge 7 is mounted into the image formation apparatus along a Z1 direction (an axial direction of the rotating component 1 or a length direction of the process cartridge 7), the power receiving unit 570 in the process cartridge 7 is engaged with a power output unit 101 in the image formation apparatus to receive the driving force, thereby driving the rotating component 1 to rotate.

FIG. 2*a* illustrates a cross-sectional view of the power receiving unit in the process cartridge and the power output unit in the image formation apparatus in an engaged state when transmitting the power. The power output unit 101 often has an overall cylindrical shape, and three radially concave recessed portions 101*a* are disposed on an outer circumference 101*f* thereof. The power receiving unit 570 in the process cartridge 7 has a hollow cylinder structure, and three claws 573 are disposed inside the hollow cylinder structure. A claws 573 is connected to the cylindrical inner wall of the hollow cylinder structure through an elastic arm 574. The claws 573 are inserted into the recessed portions 101*a*, respectively, to realize the engaged power transmission between the power receiving unit 570 in the process cartridge 7 and the power output unit 101 in the image formation apparatus.

FIG. 2*b* illustrates a cross-sectional view of the power receiving unit in the process cartridge and the power output unit in the image formation apparatus in a state when not transmitting the power. Referring to FIG. 2*b*, when the process cartridge 7 is attached to or taken out from the image formation apparatus, the outer circumferential wall of the power output unit 101 pushes the claw 573 outward to prepare for the claw 573 entering the recessed portion 101*a*, or to take out the claw 573 from the recessed portion 101*a*. During such process, the elastic arm 574 provides elastic deformation force for the claw 573. With such a structure, the elastic arm 574 is easily broken during the repeated disassembly and assembly of the process cartridge 7. Once the elastic arm 574 is broken, the image formation apparatus cannot transmit power to the process cartridge 7. The disclosed process cartridge, assembly and disassembly methods thereof are directed to solve one or more problems set forth above and other problems in the art.

BRIEF SUMMARY OF THE DISCLOSURE

One aspect of the present disclosure includes a power receiving unit of a process cartridge. The process cartridge is detachably mounted in an image formation apparatus configured with a power output unit that is swingable, an outer circumference of the power output unit contains a recessed portion, and the power receiving unit is engaged with the power output unit to receive a driving force. The power receiving unit includes a wheel hub, and the wheel hub is disposed on an end of a rotating component in the process cartridge to transmit the driving force to the rotating component. The power receiving unit also includes a power receiving part mounted inside the wheel hub. The power receiving part includes a fixing protrusion and a notch that are oppositely disposed, the fixing protrusion is inserted into the recessed portion, and the notch provides a swinging space for the power output unit. Further, the power receiving unit includes a bias part, and the bias part provides a bias force toward the fixing protrusion for the power output unit.

Another aspect of the present disclosure includes a rotating component. The rotating component includes an end disposed with a power receiving unit including the above-described power receiving unit.

Another aspect of the present disclosure includes a process cartridge comprising a frame and the above-described rotating component. Two ends of the rotating component are rotatably supported on the frame through a supporting component.

Another aspect of the present disclosure includes a power receiving unit of a process cartridge. The process cartridge is detachably mounted in an image formation apparatus configured with a power output unit that is swingable, an outer circumference of the power output unit contains a recessed portion, and the power receiving unit is engaged with the power output unit to receive a driving force. The power receiving unit includes a fixing protrusion. The fixing protrusion is disposed inside the power receiving unit, and the fixing protrusion is engaged with the recessed portion of the power output unit to receive the driving force. When the power receiving unit moves along an axial direction thereof and is in a contact engagement with the power output unit, the fixing protrusion abuts against a front end of the power output unit to cause the power output unit to be tilted and swung.

Another aspect of the present disclosure includes a power receiving unit of a process cartridge. The process cartridge is detachably mounted in an image formation apparatus configured with a power output unit that is swingable, an outer circumference of the power output unit contains a recessed portion, and the power receiving unit is engaged with the power output unit to receive a driving force. The power receiving unit includes a fixing protrusion. The fixing protrusion is disposed inside the power receiving unit, and the fixing protrusion is engaged with the recessed portion of the power output unit to receive the driving force. When the power receiving unit moves along an axial direction thereof and is disengaged from the power output unit, the fixing protrusion abuts against the recessed portion of the power output unit to cause the power output unit to be tilted and swung.

Another aspect of the present disclosure includes a process cartridge. The process cartridge is disposed with the above-described power receiving unit.

Another aspect of the present disclosure includes a method for assembling a process cartridge. The process cartridge is detachably mounted in an image formation apparatus configured with a power output unit that is swingable, an outer circumference of the power output unit contains a recessed portion, and the power receiving unit is engaged with the power output unit to receive a driving force. The power receiving unit includes a fixing protrusion. The fixing protrusion is disposed inside the power receiving unit, and the fixing protrusion is engaged with the recessed portion of the power output unit to receive the driving force. The method for assembling the process cartridge includes the following. When the process cartridge is mounted into the image formation apparatus along a length direction of the process cartridge or an axial direction of the power receiving unit, the power receiving unit is in a contact with the power output unit, and the fixing protrusion abuts against a front end of the power output unit to cause the power output unit to be tilted and swung.

Another aspect of the present disclosure includes a method for disassembling a process cartridge. The process cartridge is detachably mounted in an image formation apparatus configured with a power output unit that is swingable, an outer circumference of the power output unit contains a recessed portion, and the power receiving unit is engaged with the power output unit to receive a driving force. The power receiving unit includes a fixing protrusion. The fixing protrusion is disposed inside the power receiving unit, and the fixing protrusion is engaged with the recessed portion of the power output unit to receive the driving force. The method for disassembling the process cartridge includes the following. When the process cartridge is taken out from the image formation apparatus along a length direction of the process cartridge or an axial direction of the power receiving unit, the power receiving unit is disengaged from the power output unit, and the fixing protrusion abuts against the recessed portion of the power output unit to cause the power output unit to be tilted and swung.

In the disclosed embodiments, in one aspect, through a disposure of a fixing protrusion that is engaged with the recessed portion, the structure may be stable, and may be less likely to be broken, thereby ensuring substantially stable power transmission. In another aspect, the cooperation of the notch and the fixing protrusion may provide a tilting displacement space for the installation and insertion process and the disassembly and removal process of the power output unit in the image formation apparatus and the power receiving unit in the process cartridge, which may avoid interference or inaccessibility issue, and ensure smooth installation and removal. In another aspect, the bias part may improve the stability of the engagement power transmission process.

Other aspects of the present disclosure can be understood by those skilled in the art in light of the description, the claims, and the drawings of the present disclosure.

BRIEF DESCRIPTION OF THE DRAWINGS

To more clearly illustrate the embodiments of the present disclosure, the drawings will be briefly described below. The drawings in the following description are certain embodiments of the present disclosure, and other drawings may be obtained by a person of ordinary skill in the art in view of the drawings provided without creative efforts.

DETAILED DESCRIPTION

Reference will now be made in detail to exemplary embodiments of the disclosure, which are illustrated in the accompanying drawings. Wherever possible, the same reference numbers will be used throughout the drawings to refer to the same or the alike parts. The described embodiments are some but not all of the embodiments of the present disclosure. Based on the disclosed embodiments, persons of ordinary skill in the art may derive other embodiments consistent with the present disclosure, all of which are within the scope of the present disclosure.

The present disclosure provides a power receiving unit disposed on a process cartridge for receiving a driving force from an image formation apparatus and transmitting the driving force to a rotating component in the process cartridge. The disclosed power receiving unit may be quickly, reliably, and stably engaged to a power output unit in the image formation apparatus to receive the driving force.

In one embodiments, an axial (a length) direction of the process cartridge may be substantially coaxial or parallel to a rotary shaft of a developing component. A mounting direction for mounting the process cartridge into an electronic imaging apparatus may be the same as the axial (length) direction of the process cartridge or an axial direction of the rotary shaft of the developing component. A direction for disassembling (detaching) the process cartridge from the electronic imaging apparatus may be opposite to the mounting direction of the process cartridge.

Embodiment 1

Figure 1A:
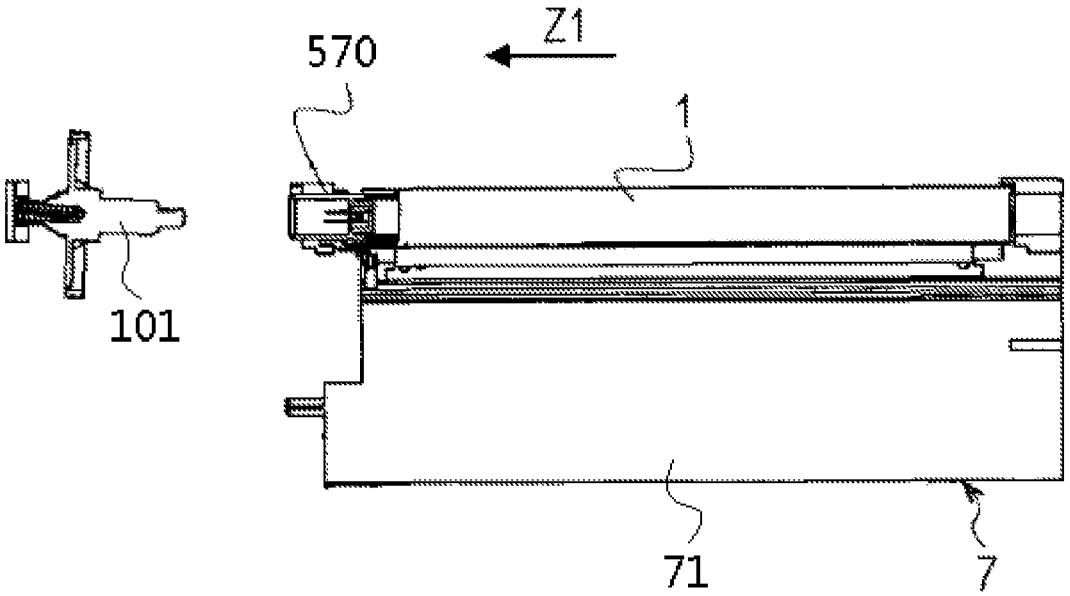
FIGS. 1*a* and 1*b* illustrate schematic diagrams of a process cartridge for receiving a driving force from an image formation apparatus.
Figure 1B:
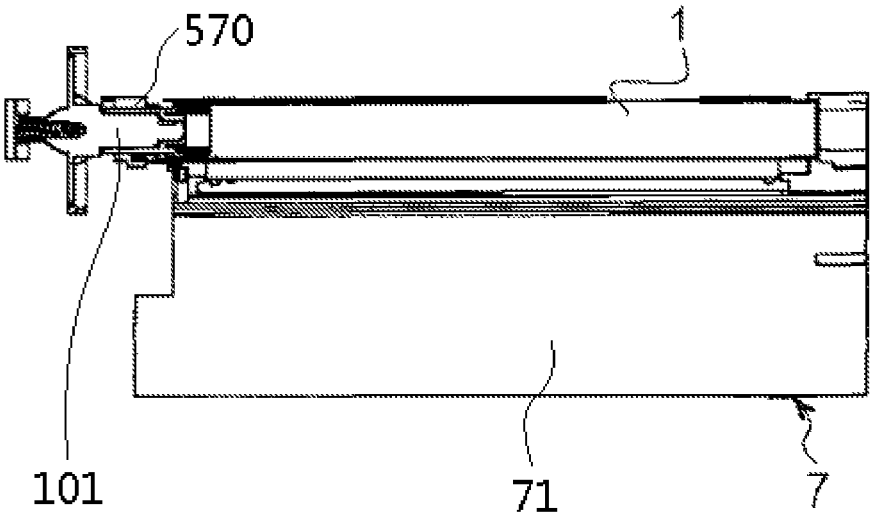
Figure 2A:
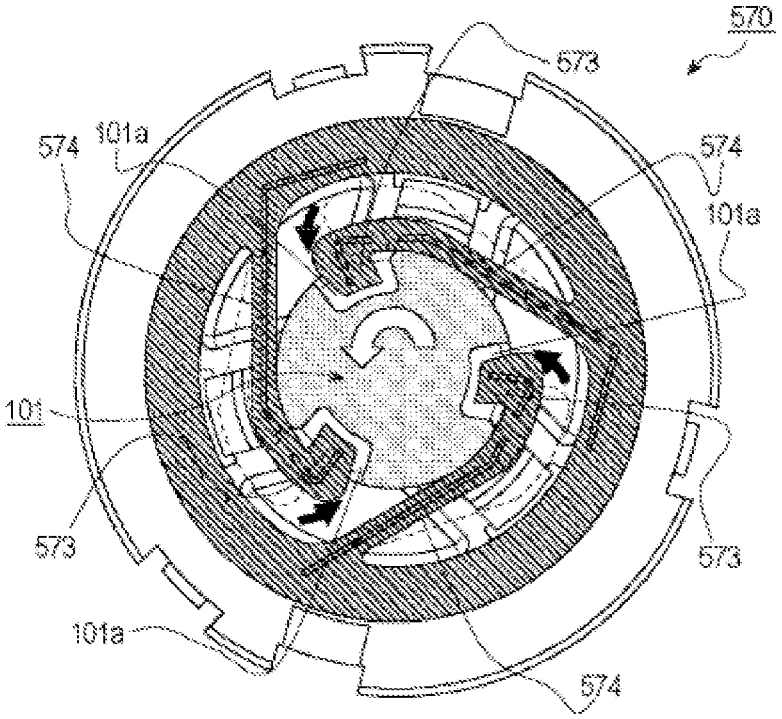
FIG. 2*a* illustrates a cross-sectional view of a power receiving unit in a process cartridge and a power output unit in an image formation apparatus in an engaged state when transmitting the power.
Figure 2B:
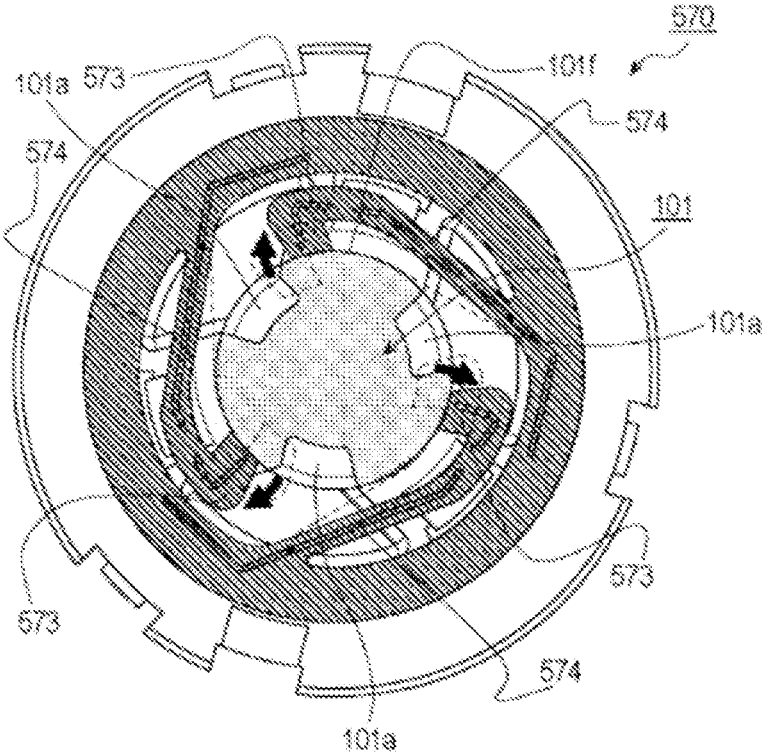
FIG. 2*b* illustrates a cross-sectional view of a power receiving unit in a process cartridge and a power output unit in an image formation apparatus in a state when not transmitting the power.
Figure 3:
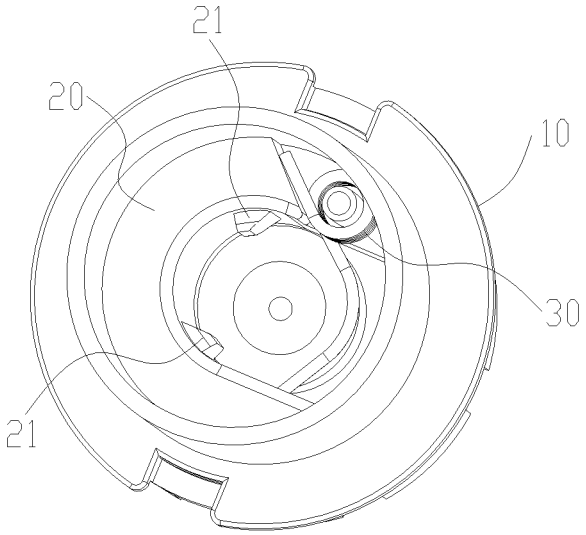
FIG. 3 illustrates a perspective view of a power receiving unit in an exemplary process cartridge consistent with various disclosed embodiments of the present disclosure.
Figure 4:
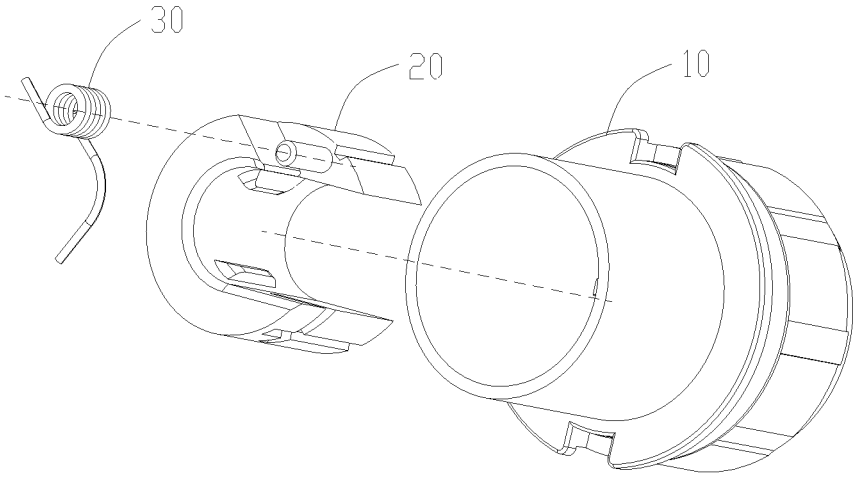
FIG. 4 illustrates an exploded perspective view of a power receiving unit in an exemplary process cartridge consistent with various disclosed embodiments of the present disclosure.

FIG. 3 illustrates a perspective view of the power receiving unit of the process cartridge consistent with disclosed embodiments of the present disclosure; and FIG. 4 illustrates an exploded perspective view of the power receiving unit. Referring to FIG. 3 and FIG. 4, the power receiving unit may include a wheel hub 10, a power receiving part 20 and a bias part 30. The wheel hub 10 may be fixed to an end of a rotating component in the process cartridge to transmit a driving force to the rotating component. The power receiving part 20 may be mounted inside the wheel hub 10, and a fixing protrusion 21, which is engaged with a recessed portion of the power output unit in the image formation apparatus, may be disposed on the inner wall of the power receiving part 20. The power receiving part 20 may further include a notch 22, and the notch 22 may be disposed opposite to the fixing protrusion 21. The notch 22 may provide a certain swinging space for a power output unit 101. The bias part 30 may be disposed on a side where the notch 22 is located, and may provide a bias force toward the fixing protrusion 21 for the power output unit in the image formation apparatus.

In one embodiment, a quantity of the fixing protrusions 21 may be one or two. For illustrative purposes, two fixing protrusions are used as an example in the disclosed embodiments. The bias part 30 may be a component having an elastic function, e.g., a tension spring, a rubber band, a torsion spring, or a leaf spring, etc. Alternatively, the bias part may be a pair of magnets, etc. For illustrative purposes, a torsion spring is used as an example in the disclosed embodiments.

Figure 5:
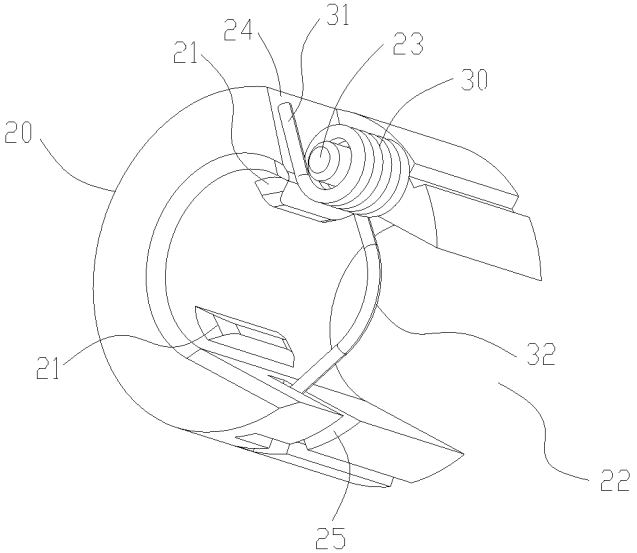
FIG. 5 illustrates a schematic diagram for assembling a power receiving part and a bias part consistent with various disclosed embodiments of the present disclosure.

FIG. 5 illustrates a schematic diagram for assembling a power receiving part and a bias part consistent with disclosed embodiments of the present disclosure. Referring to FIG. 5, a mounting portion 23 for mounting the bias part 30 and an abutting portion 24 abutted against a short side 31 of the bias part 30 may be disposed on an end of the notch 22. A slit 25 for providing a movable space for a long side 32 of the bias part 30 may be disposed on another end of the notch 22.

Figure 6A:
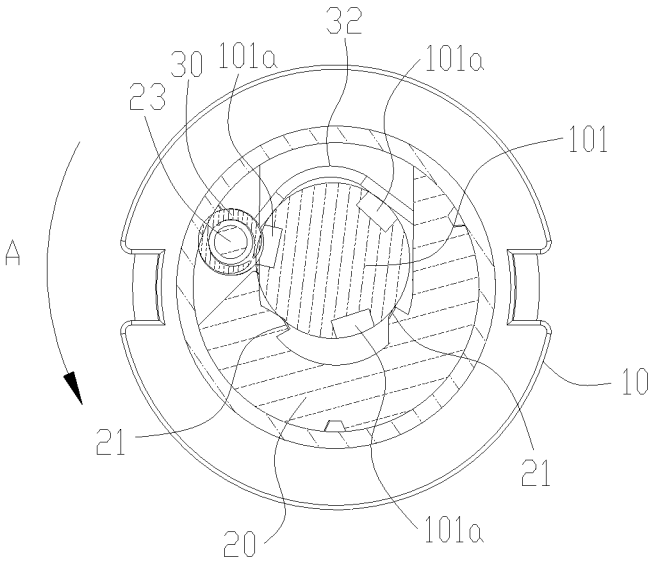
FIG. 6*a* illustrates a cross-sectional view of a power receiving unit in an exemplary process cartridge and a power output unit in an image formation apparatus in an engaged state when not transmitting the power consistent with various disclosed embodiments of the present disclosure.
Figure 6B:
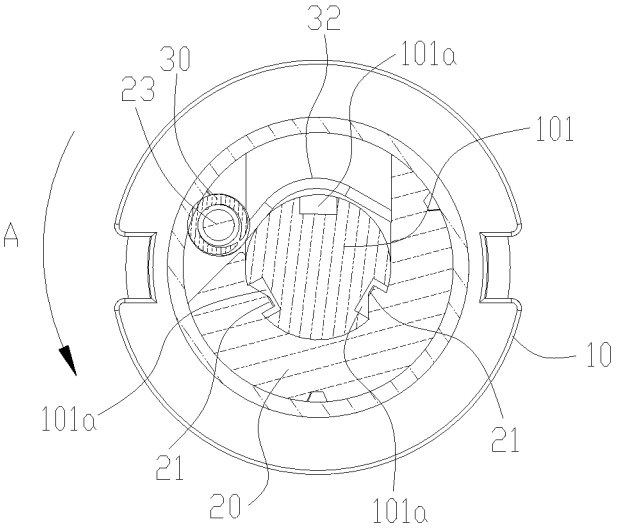
FIG. 6*b* illustrates a cross-sectional view of a power receiving unit in an exemplary process cartridge and a power output unit in an image formation apparatus in an engaged state when transmitting the power consistent with various disclosed embodiments of the present disclosure.

FIG. 6*a* illustrates a cross-sectional view of the power receiving unit in the process cartridge and the power output unit in the image formation apparatus in an engaged state when not transmitting the driving force consistent with disclosed embodiments of the present disclosure. FIG. 6*b* illustrates a cross-sectional view of the power receiving unit in the process cartridge and the power output unit in the image formation apparatus in an engaged state when transmitting the driving force consistent with disclosed embodiments of the present disclosure. Referring to FIGS. 6*a* and 6*b*, when mounting the process cartridge into the image formation apparatus, the power output unit 101 may be inserted into the power receiving part 20. The positions of the fixing protrusion 21 and a recessed portion 101*a* may be arbitrary, for illustrative purposes, the relative positions of the fixing protrusion 21 and the recessed portion 101*a* are shifted as an example.

In a process of inserting the power output unit 101 into the power receiving part 20 and after the insertion is completed, the power output unit 101 and the power receiving part 20 may be in a state illustrated in FIG. 6*a*. In view of this, the power output unit 101 may be topped by the fixing protrusion 21 toward the bias part 30, and the long side 32 of the bias part 30 may apply a force toward the fixing protrusion 21 side on the power output unit 101. When the power output unit 101 is rotated along a 'A' direction until the fixing protrusion 21 reaches a position coincided with the recessed portion 101*a*, the fixing protrusion 21 may be caught in the recessed portion 101*a* under the restoring force of the bias part 30 (as illustrated in FIG. 6*b*), and the power receiving unit in the process cartridge may rotate along the 'A' direction together with the power output unit 101 in the image formation apparatus. When the power receiving unit is detached from the power output unit 101, because the power output unit 101 in the image formation apparatus can swing and the bias part 30 is disposed, the fixing protrusion 21 may be axially detached from the recessed portion 101*a* to disengage.

Guide bevels (an inclined surface or a curved surface) may be disposed on the front and rear (axial direction) ends of the fixing protrusion 21, such that the fixing protrusion 21 may be smoothly inserted into or detached from the recessed portion 101*a*.

Embodiment 2

The difference between the present embodiment and the above-described embodiment may include that the bias part in the present embodiment may be disposed on the inner wall of the wheel hub.

Figure 7:
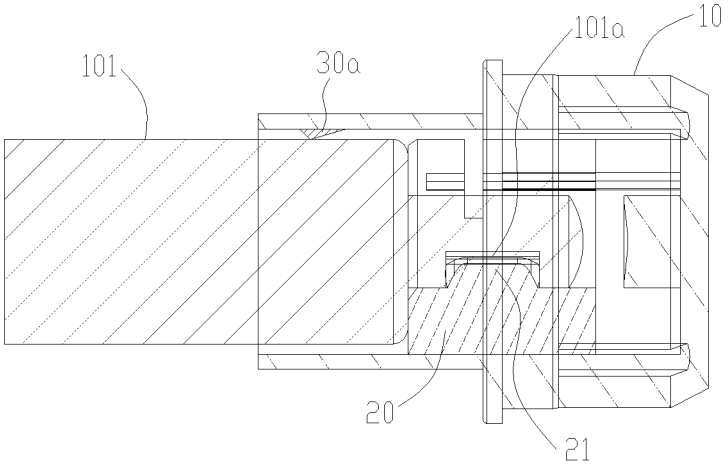
FIG. 7 illustrates a cross-sectional view of a power receiving unit in another exemplary process cartridge and a power output unit in an image formation apparatus in an engaged state when transmitting the power consistent with various disclosed embodiments of the present disclosure.

FIG. 7 illustrates a cross-sectional view of a power receiving unit in the process cartridge and a power output unit in the image formation apparatus in an engaged state when transmitting the driving force consistent with disclosed embodiments of the present disclosure. The bias part 30*a* may be disposed on the inner wall of the wheel hub 10. In one embodiment, the bias part 30*a* may be an elastic structure integrally formed with the wheel hub 10. In another embodiment, the bias part 30*a* may be a separately installed elastic part. The bias part 30*a* may be disposed on a side opposite to the fixing protrusion 21.

In the above-described embodiments, the bias part may be a component having an elastic function, e.g., a tension spring, a rubber band, a torsion spring, or a leaf spring, etc. Alternatively, the bias part may be a pair of magnets, etc. The wheel hub 10 may be integrally formed with the power receiving part 20. A holder 11 of the wheel hub 10 may be fixedly connected to a rotating component, e.g., a photosensitive component (photosensitive drum), in the process cartridge. The power receiving unit may be fixed to the frame of the process cartridge by a supporting component.

Embodiment 3

Figure 8:
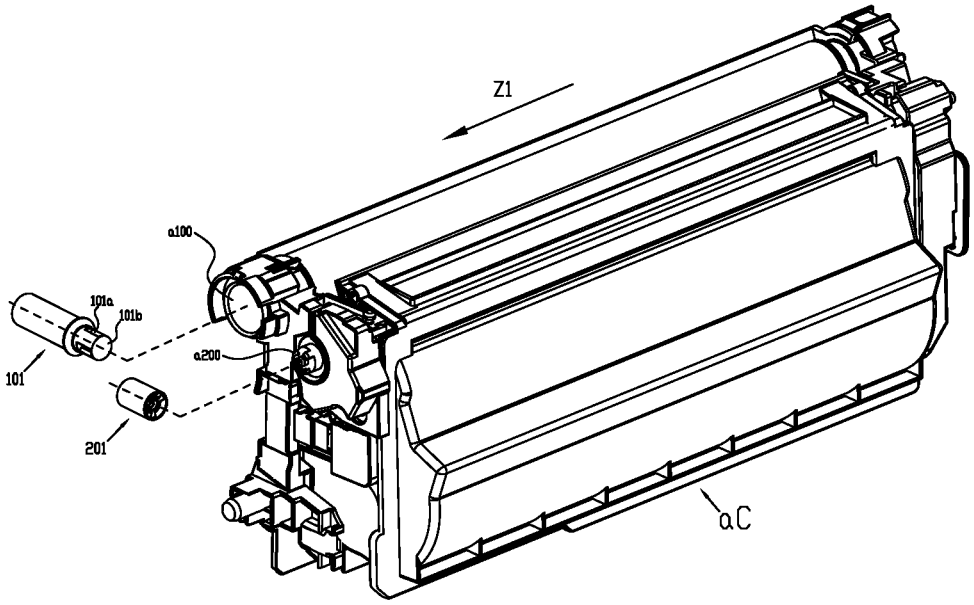
FIG. 8 illustrates a schematic diagram of a power receiving unit in another exemplary process cartridge and a power output unit in an image formation apparatus consistent with various disclosed embodiments of the present disclosure.
Figure 9:
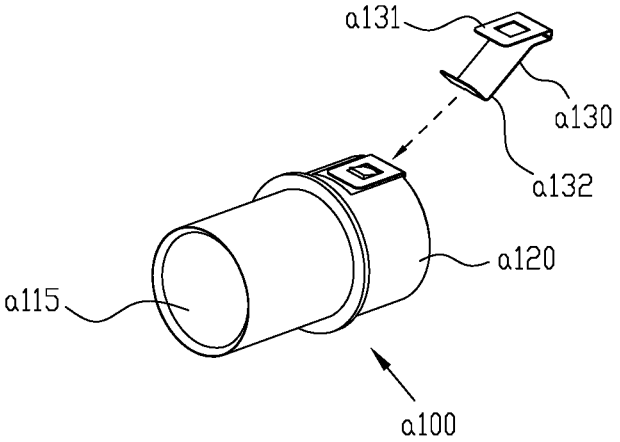
FIG. 9 illustrates a schematic diagram of a power receiving unit in another exemplary process cartridge consistent with various disclosed embodiments of the present disclosure.

FIGS. 8-9 illustrates schematic diagrams of the power receiving unit in the process cartridge. The parts that are not described in detail in the Embodiment 3 may refer to the descriptions associated with structures, functions, and operations of the same or similar parts in the above-described embodiments, which are not repeated herein.

(Processing Cartridge)

Referring to FIG. 8, the power receiving unit a100 may be disposed on one end of the process cartridge aC in the axial (length) direction. The power receiving unit a100 may be mounted into the image formation apparatus along a direction Z1 to engage with the power output unit 101 to receive the rotational driving force and transmit the rotational driving force to the rotating component in the process cartridge aC to make it rotated.

(Power Receiving Unit)

Referring to FIGS. 9-12*a*, the power receiving unit a100 may include a wheel hub a120, a power receiving part a110, and a bias part a130. The wheel hub a120 may be directly or indirectly connected to the rotating component in the process cartridge aC to transmit a driving force to the rotating component. The wheel hub a120 may have a hollow cylindrical structure, and may include an inner hole a115. The power receiving part a110 may be disposed inside the wheel hub a120. A trapezoidal shaped fixing protrusion a111 may be disposed on the inner wall of the power receiving part a110. The fixing protrusion a111 may be disposed around the rotary shaft of the power receiving part a110. A quantity of the fixing protrusions a111 may be one or two.

Figure 10:
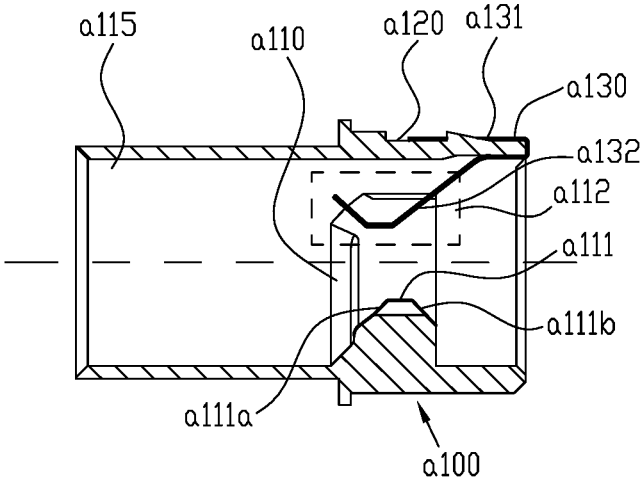
FIGS. 10-12*a* illustrate internal structural schematic diagrams of a power receiving unit in another exemplary process cartridge consistent with various disclosed embodiments of the present disclosure.
Figure 11:
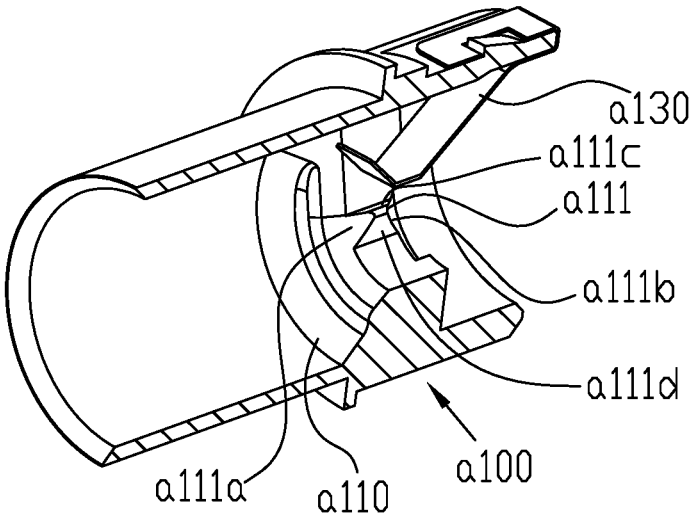
Figure 12:
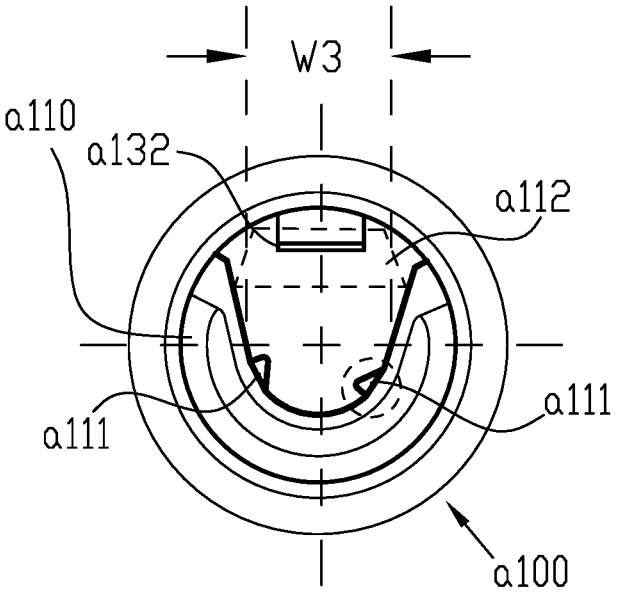
Figure 12A:
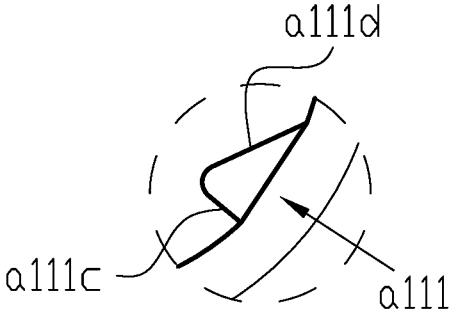

As viewed from the axial direction of the power receiving unit a100, referring to FIG. 10, a guide bevel a111*a* may be formed on the outward end (front end) of the fixing protrusion a111, and another guide bevel a111*b* may be formed on the inward end (rear end) thereof. As viewed from the end direction of the power receiving unit a100, referring to FIGS. 11-12*a*, a substantially upright engagement side a111*c* may be formed on a side of the fixing protrusion a111, and a guide bevel a111*d* may be formed on another side of the fixing protrusion a111. A notch a112 may be formed inside the power receiving part a110 and opposite to the fixing protrusion a111. A minimum distance of the notch a112 is W3. The bias part a130 may be disposed on the wheel hub a120, and may be inserted into the contour of the wheel hub a120 through an intermediate "U"-shaped structure. One side (short side) a131 of the bias part a130 may be fixed to the protrusion of the outer surface of the wheel hub a120, and another side (long side) a132 of the bias part a130 may be disposed on the inside the wheel hub a120. The side (long side) a132 of the bias part a130 may be extended into the notch a112 of the power receiving part a110. As viewed from the end direction of the power receiving unit a100, the side (long side) a132 may be disposed opposite to the fixing protrusion a111, and a portion (the side (long side) a132) of the bias part a130 may be overlapped with the notch a112.

(Power Output Unit)

Figure 13:
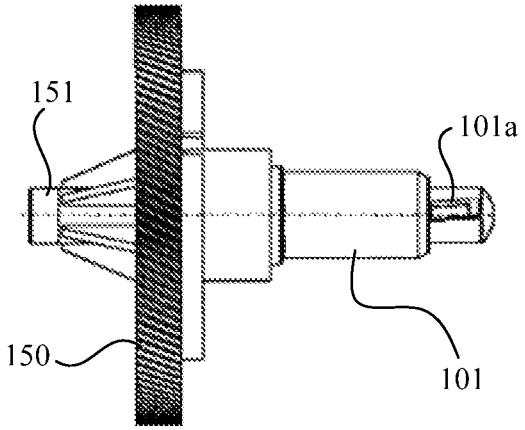
FIGS. 13-15 illustrate schematic diagrams of a power output unit in an image formation apparatus consistent with various disclosed embodiments of the present disclosure.
Figure 14:
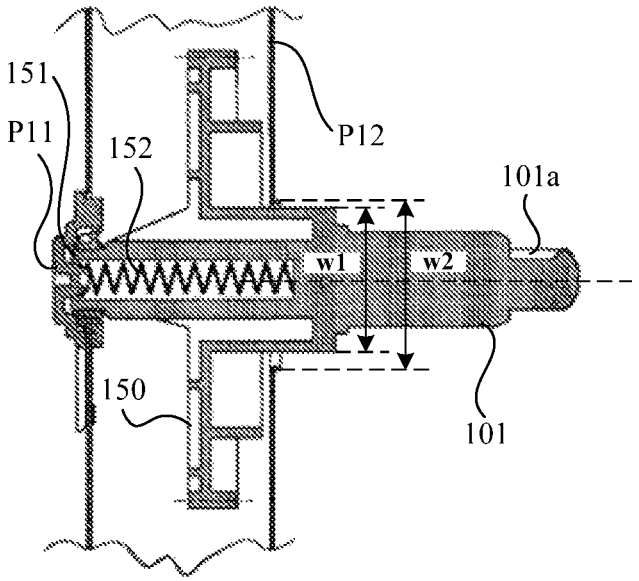

Referring to FIG. 13, the power output unit 101 in the image formation apparatus may be coupled to one side of a gear base 150, and a mounting post 151 may be disposed on the other side of the gear base 150. Referring to FIG. 14, the mounting post 151 of the gear base 150 may be rotatably coupled to a holder P11 disposed on an outer frame of the image formation apparatus. The middle part (cylindrical) of the gear base 150 may pass through an inner frame P12 of the image formation apparatus. A reset elastic part 152 may be disposed inside the gear base 150. The reset elastic part 152 may enable the power output unit 101 and the gear base 150 to be integrally expanded and contracted along the axial direction thereof with respect to the inner frame P12. At the same time, because the aperture W2 of the inner frame P12 is larger than the middle part W1 of the gear base 150, the power output unit 101 may have a certain radial movement space for substantially swinging in the image formation apparatus. The power output unit 101 may be tilted with respect to the inner frame P12 when being subjected to an external force. When the external force is removed, the reset elastic part 152 may enable the power output unit 101 to be restored from the tilted state to the initial state.

Figure 15:
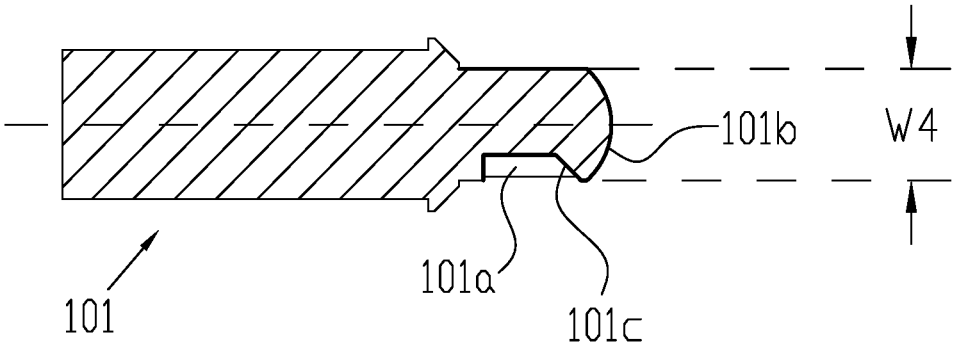
Figure 16:
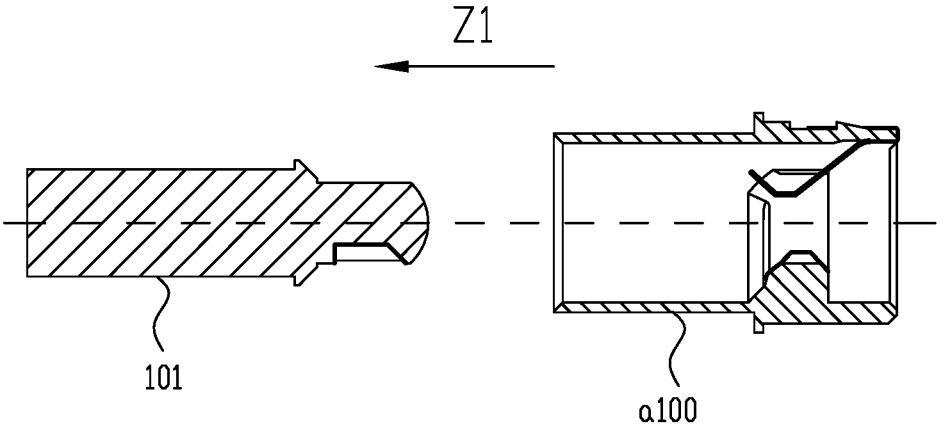
FIGS. 16-18*b* illustrate schematic diagrams of a process of contact engagement between a power receiving unit in an exemplary process cartridge and a power output unit in an image formation apparatus consistent with various disclosed embodiments of the present disclosure.

Referring to FIG. 15, the power output unit 101 may often have an overall cylindrical shape, and three radially concave recessed portions 101*a* may be disposed on the outer circumference of the power output unit 101. An arc-shaped protrusion portion 101*b* may be disposed on the front end of the power output unit 101. A guide bevel 101*c* may be formed on one end of the recessed portion 101*a* close to the protrusion portion 101*b*. A diameter of the front end of the power output unit 101 is W4.

(Contact Engagement Between the Power Receiving Unit and the Power Output Unit)

FIGS. 16-18*b* illustrate schematic diagrams of a contact engagement between the power receiving unit a100 in the process cartridge and the power output unit 101 in the image formation apparatus. When the power receiving unit a100 is mounted into the image formation apparatus along the direction Z1 (axial direction) and is in contact engagement with the power output unit 101, the protrusion portion 101*b* on the front end of the power output unit 101 may first abut against the guide bevel a111*a* of the fixing protrusion a111. The power output unit 101 may swing to a certain extent, and the minimum distance W3 of the notch a112 may be greater than or equal to the diameter W4 of the power output unit 101. With the continuation of the mounting movement of the process cartridge C, the guide bevel a111*a* of the fixing protrusion a111 may push the protrusion portion 101*b* of the power output unit 101 to cause the power output unit 101 to be tilted by the external force and to be moved toward the notch a112. In view of this, a rotation axis of the power output unit 101 may be inclined with respect to a rotation axis of the power receiving unit a100 (there is an inclination angle R1).

Figure 17:
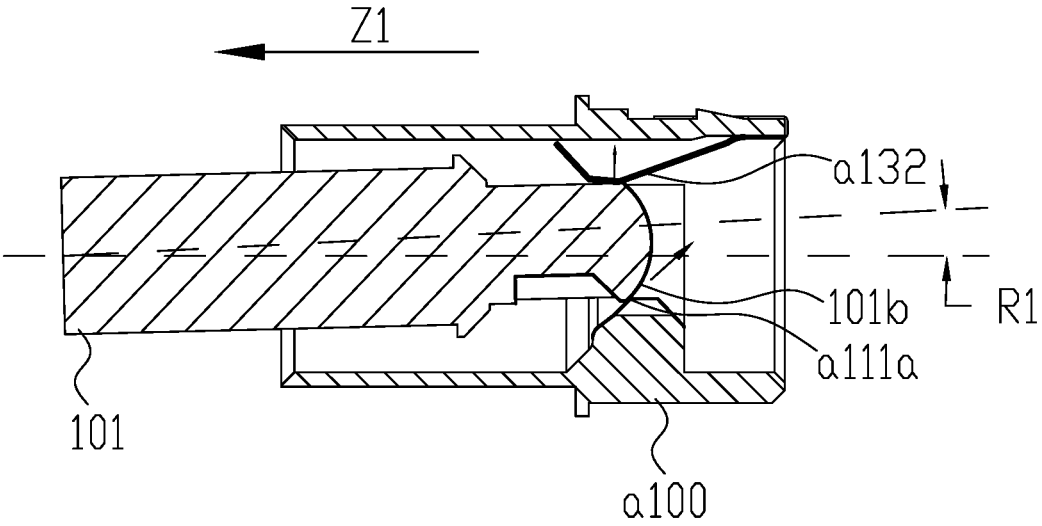
Figure 17B:
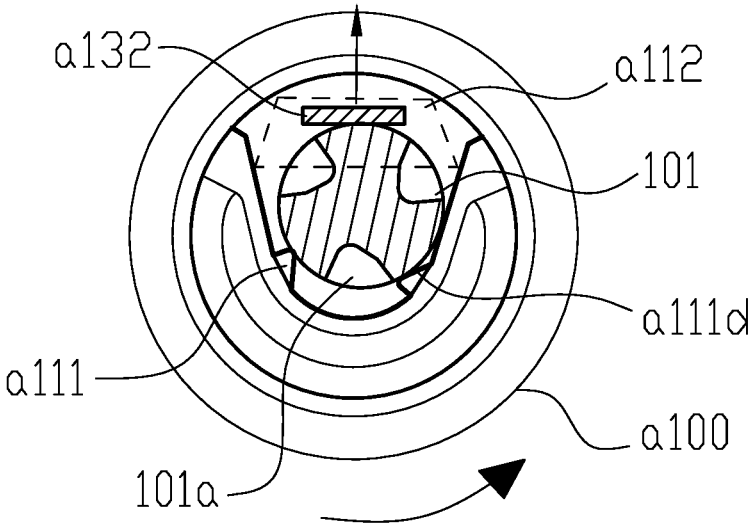
Figure 18A:
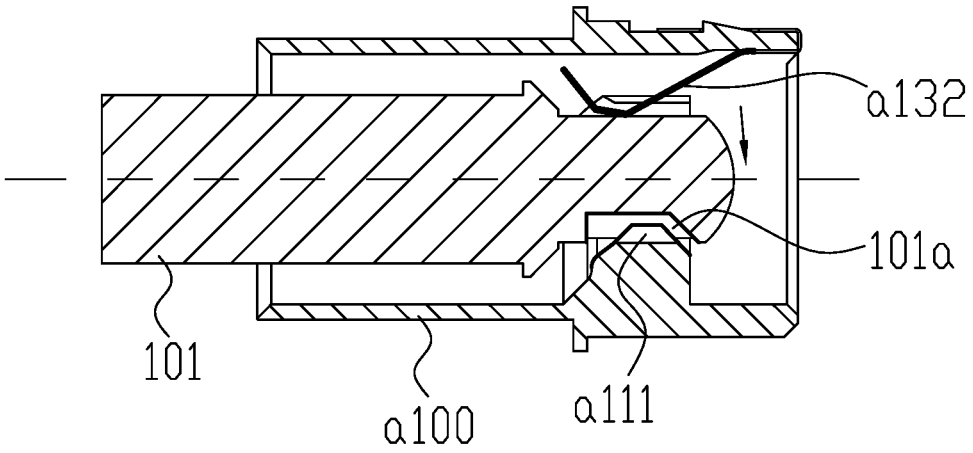
Figure 18B:
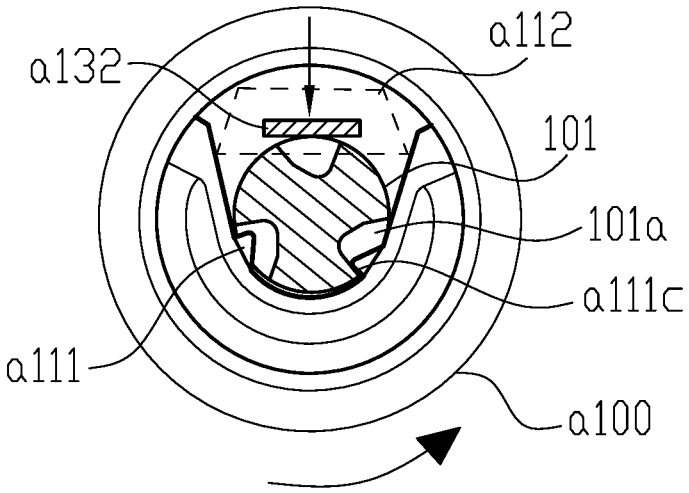

In the above-described mounting process, the guide bevel a111*a* of the fixing protrusion a111 may cause the power output unit 101 to be tilted, thereby avoiding structural interference between the power output unit 101 and the fixing protrusion a111. Referring to FIG. 17*b*, after mounting the power receiving unit a100, even if the fixing protrusion a111 and the recessed portion 101*a* have a staggered relative position and are not engaged, after the motor drives the power output unit 101 to rotate counterclockwise, the recessed portion 101*a* of the power output unit 101 may move to a position corresponding to the fixing protrusion a111, and the cylindrical surface of the power output unit 101 may no longer abut against the fixing protrusion a111. In view of this, the reset elastic part 152 in the gear base 150 may enable the power output unit 101 to be restored from the tilt state to the initial state. The fixing protrusion a111 may be caught into the recessed portion 101*a* to receive the rotational driving force, as illustrated in FIG. 18*b*.

(Disengagement Between the Power Receiving Unit and the Power Output Unit)

Figure 19:
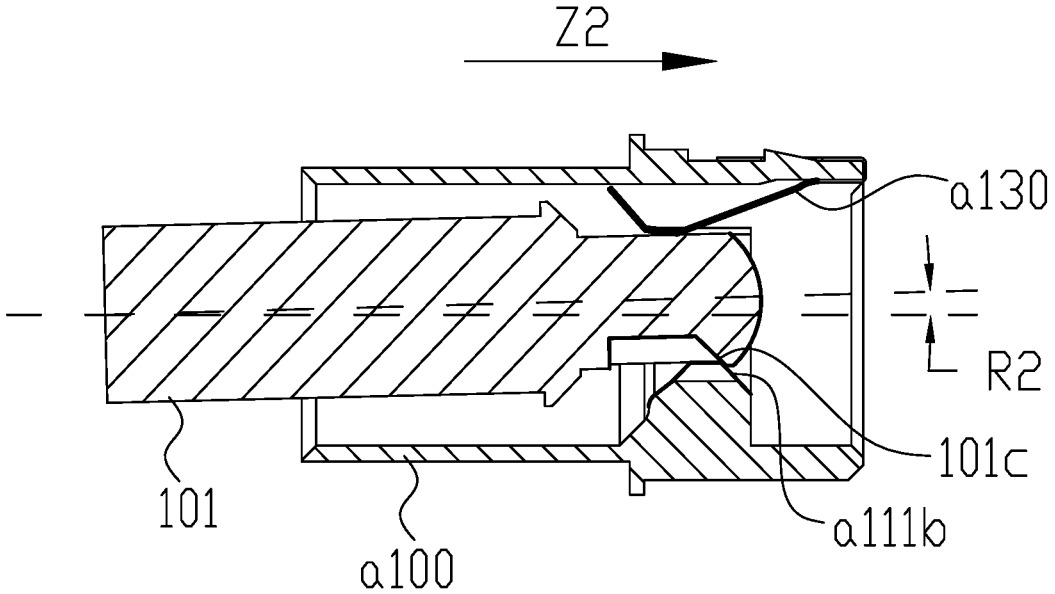
FIG. 19 illustrates a schematic diagram of a process of disengagement between a power receiving unit in an exemplary process cartridge and a power output unit in an image formation apparatus consistent with various disclosed embodiments of the present disclosure.

FIG. 19 illustrates a schematic diagram of a disengagement between the power receiving unit a100 in the process cartridge and the power output unit 101 in the image formation apparatus. Referring to FIG. 19, when the power receiving unit a100 moves along the direction Z2 (reverse of the direction Z1) to be disengaged from the power output unit 101 in the image formation apparatus, the guide bevel a111*b* of the fixing protrusion a111 may abut against the guide bevel 101*c* in the recessed portion 101*a* of the power output unit 101. With the continuation of the detaching movement of the process cartridge C, the guide bevel a111*b* may push the guide bevel 101*c* to enable the power output unit 101 to be tilted by the external force and to be moved toward the notch a112. In view of this, a rotation axis of the power output unit 101 may be inclined with respect to a rotation axis of the power receiving unit a100 (there is an inclination angle R2). With the tilting movement of the power output unit 101, the fixing protrusion a111 may be disengaged from the recessed portion 101*a*. When the power output unit 101 is no longer in contact with the fixing protrusion a111, the power output unit 101 may be restored from the tilted state to the initial state under the action of the reset elastic part 152.

In addition, during the above-described process (contact engagement between the power receiving unit and the power output unit), referring to FIGS. 17*a*-18*b*, through auxiliary disposure of the bias part a130, after the power output unit 101 abuts against the fixing protrusion a111 and is tilted, the side a132 (long side) of the bias part a130 may be deformed by the thrust of the power output unit 101. When the recessed portion 101*a* of the power output unit 101 moves to a position corresponding to the fixing protrusion a111, the side a132 (long side) of the bias part a130 may apply an elastic force to push the cylindrical surface of the power output unit 101 to enable the power output unit 101 to be moved toward the fixing protrusion a111.

At the same time, in the process of engagement between the power receiving unit and the power output unit for receiving the power, the side a132 (long side) of the bias part a130 may also apply the elastic force to push the cylindrical surface of the power output unit 101 to enable the fixing protrusion a111 of the power receiving unit a100 to be not disengaged from the recessed portion 101*a* of the power output unit 101.

Moreover, in the process cartridge aC, referring to FIG. 8, a convex power receiving unit a200 may be disposed on a same end as the power receiving unit a100. The convex power receiving unit a200 may be engaged with a concave power output unit 201 to receive the rotational driving force. The power receiving unit a100 and the convex power receiving unit a200 may be separately independent units to drive the respective rotating components to rotate. In one embodiment, the power receiving unit a100 may drive the photosensitive component a10 to rotate, and the convex power receiving unit a200 may drive the developing component a20 to rotate.

Figure 20:
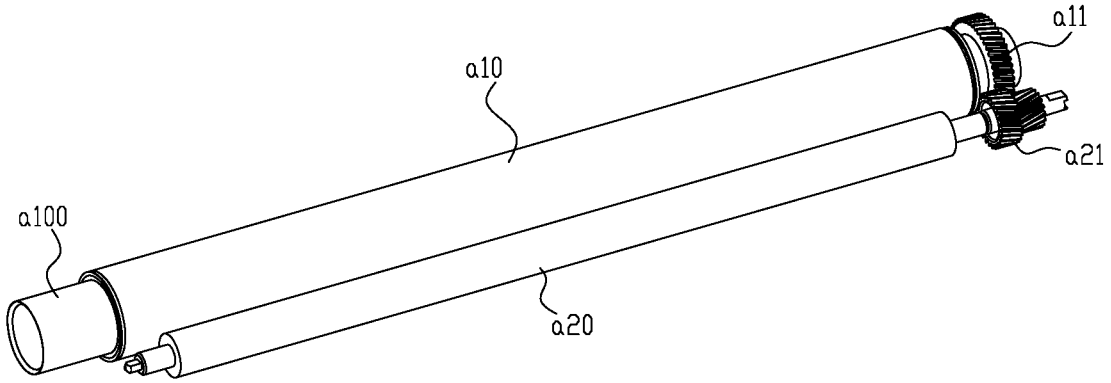
FIGS. 20-21 illustrate schematic diagrams of transfer parts of a photosensitive component and a developing component in an exemplary process cartridge consistent with various disclosed embodiments of the present disclosure.
Figure 21:
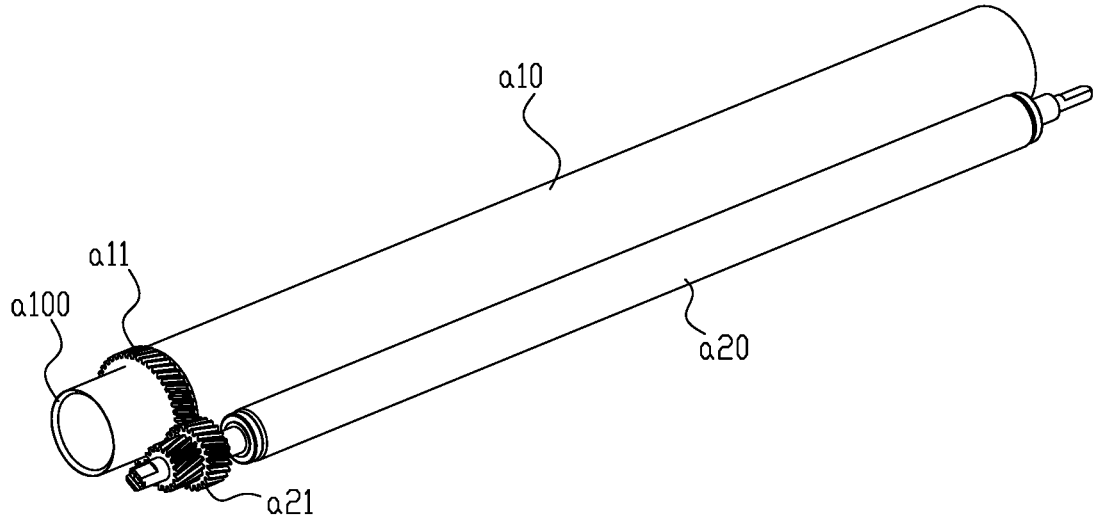
Figure 22:
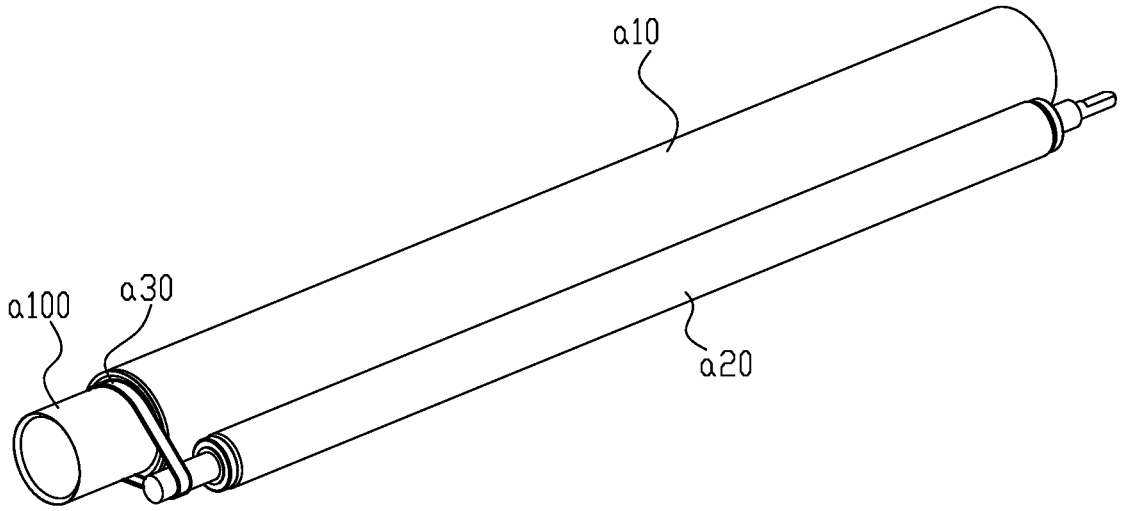
FIGS. 22-23 illustrate schematic diagrams of a transmission belt in an exemplary process cartridge consistent with various disclosed embodiments of the present disclosure.
Figure 23:
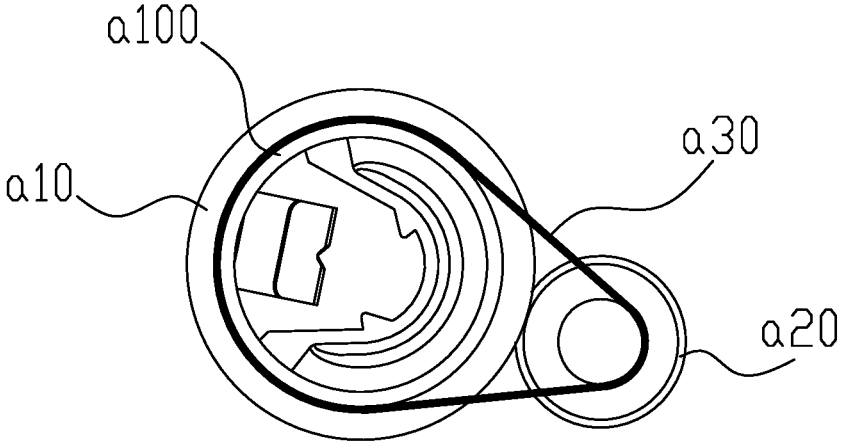

Further, to make the relative rotation substantially stable, a quantity of components in the process cartridge may be reduced, and the convex power receiving unit a200 may be eliminated. Referring to FIG. 20, a pair of transfer parts a11 and a21 (gears) may be added on one end of the photosensitive component a10 and the developing component a20. Through the disposure of the transfer parts a11 and a21, the power receiving unit a100 may simultaneously drive the photosensitive component a10 and the developing component a20 to rotate after receiving the rotational driving force from the power output unit 101. Referring to FIG. 21, the transfer parts a11 and a21 may be disposed on the same end as the power receiving unit a100, and the transfer part a11 may be integrally disposed with the power receiving unit a100. Further, referring to FIGS. 22-23, the transfer parts a11 and a21 (gears) may be replaced by a belt a30, an inner side of the belt a30 may be sleeved on an outer side of the power receiving unit a100, and another inner side of the belt a30 may be sleeved on the axial center of the developing part a20. The belt a30 may be disposed on one end (driving end or conductive end) or both ends of the photosensitive component a10 and the developing component a20.

Embodiment 4

Figure 24:
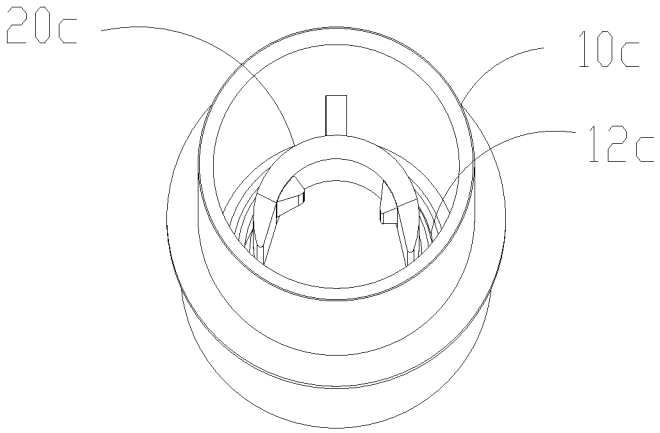
FIGS. 24-25 illustrate perspective views of a power receiving unit in another exemplary process cartridge consistent with various disclosed embodiments of the present disclosure.
Figure 25:
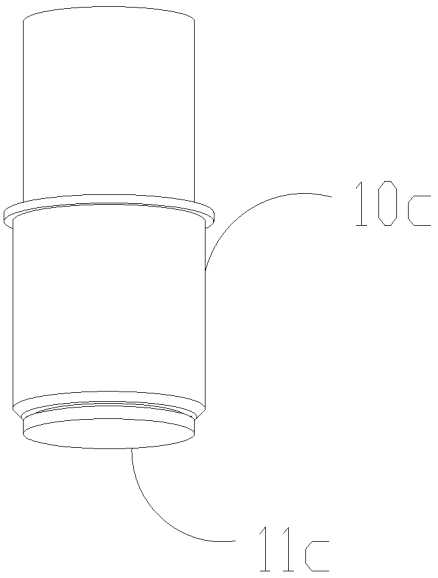

FIGS. 24-25 illustrate perspective views of the power receiving unit in the process cartridge consistent with disclosed embodiments of the present disclosure. The power receiving part 20*c* may be mounted inside the wheel hub 10*c* and on the base 11*c*. An elastic part 12*c* may be disposed between the base 11*c* and the power receiving part 20*c* to enable the power receiving part 20*c* to be expanded and contracted along the axial direction of the rotational shaft of the power receiving unit and to translate with respect to the base 11*c*.

Figure 26:
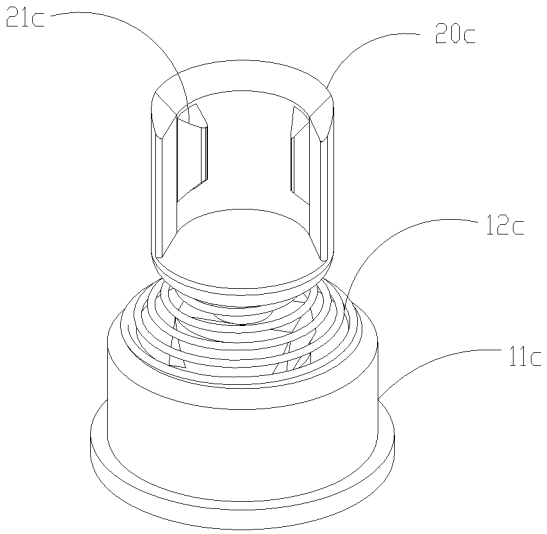
FIG. 26 illustrates a perspective view of an internal structure of a power receiving unit in another exemplary process cartridge consistent with various disclosed embodiments of the present disclosure.
Figure 27:
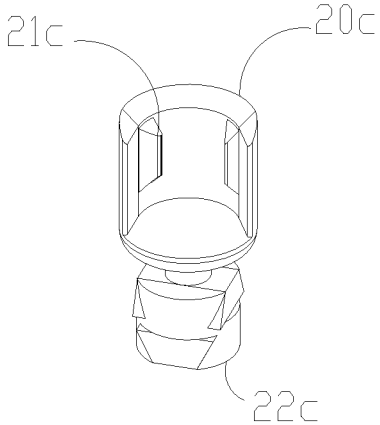
FIG. 27 illustrates a perspective view of a power receiving part of a power receiving unit in another exemplary process cartridge consistent with various disclosed embodiments of the present disclosure.

FIG. 26 illustrates a perspective view of the power receiving unit after removing the wheel hub 10*c*, and FIG. 27 illustrates a perspective view of the power receiving part 20*c*. A fixing protrusion 21*c* and a trapezoidal block 22*c* may be disposed on the power receiving part 20*c*. The trapezoidal block 22*c* may be closer to the base 11*c* than the fixing protrusion 21*c*. The trapezoidal block 22*c* may allow the power receiving part 20*c* to translate inside the wheel hub 10*c*.

A quantity of the fixing protrusions 21*c* may be at least one. In one embodiment, a quantity of the fixing protrusions 21*c* may be two. A quantity of the trapezoidal blocks 22*c* may be at least one, and the trapezoidal block 22*c* may have at least one inclined surface. In one embodiment, a quantity of the trapezoidal blocks 22*c* may be two (forming a cross-coaxial structure), and each trapezoidal block 22*c* may have two inclined surfaces. At the same time, the angle between every two inclined surfaces may be 90 degrees.

Similarly, other couplings may be used to replace the trapezoidal block 22*c* in the disclosed embodiments, such that the power receiving part 20*c* may be fixed to the inside of the wheel hub 10*c*, and the power receiving part 20*c* may translate inside the wheel hub 10*c*.

Figure 28:
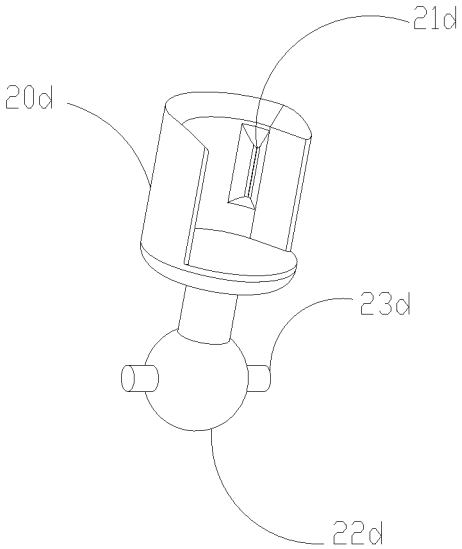
FIG. 28 illustrates a perspective view of a power receiving part of a power receiving unit in another exemplary process cartridge consistent with various disclosed embodiments of the present disclosure.

FIG. 28 illustrates a perspective view of another power receiving part 20*d* consistent with disclosed embodiments in the present disclosure. Referring to FIG. 28, the power receiving part 20*d* may include a fixing protrusion 21*d*, a ball portion 22*d*, and a transfer portion 23*d*. In one embodiment, the transfer portion 23*d* may be located on the ball portion 22*d* for transmitting power to the wheel hub 10*c*. The power receiving part 20*d* illustrated in FIG. 28 may be interchangeable with the power receiving part 20*c* illustrated in FIG. 27.

A quantity of the fixing protrusions 21*d* may be at least one. In one embodiment, a quantity of the fixing protrusions 21*d* may be two. Similarly, a recessed hole for carrying the ball portion 22*d* of the power receiving part 20*d* may be disposed on the base, such that the power receiving part 20*d* may rotate inside the wheel hub.

The description of the disclosed embodiments is provided to illustrate the present invention to those skilled in the art. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A process cartridge, detachably mounted in an image formation apparatus configured with a power output unit that is swingable, an outer circumference of the power output unit contains a recessed portion, the process cartridge comprising:

a power receiving unit, comprising a wheel hub and a power receiving member connected with the wheel hub, the power receiving member being engaged with the power output unit to receive a driving force;

wherein the wheel hub comprises a hollow cylinder portion accommodating the power output unit;

wherein the power receiving member includes a fixing protrusion, the fixing protrusion is engaged with the recessed portion of the power output unit to receive the driving force;

wherein the power receiving unit further comprises a bias part, the bias part applies a bias force to drive the power output unit to move to engage with the fixing protrusion.

2. The process cartridge according to claim 1, wherein:

the wheel hub is disposed on an end of a rotating component in the process cartridge to transmit the driving force to the rotating component.

3. The process cartridge according to claim 1, wherein:

the power receiving member further includes a notch, which provides a swinging space for the power output unit.

4. The process cartridge according to claim 3, wherein:

the bias part is disposed on a side where the notch is located.

5. The process cartridge according to claim 1, wherein:

the bias part is mounted on an inner wall of the wheel hub.

6. The process cartridge according to claim 1, wherein:

the bias part is an elastic part.

7. The process cartridge according to claim 1, wherein:

a guide bevel is formed on an end of the fixing protrusion.

8. A power receiving unit of a process cartridge, wherein the process cartridge is detachably mounted in an image formation apparatus configured with a power output unit that is swingable, an outer circumference of the power output unit contains a recessed portion, and the power receiving unit is engaged with the power output unit to receive a driving force, the power receiving unit comprising:

a wheel hub, wherein the wheel hub comprises a hollow cylinder portion accommodating the power output unit;

a power receiving member, connected with the wheel hub, wherein the power receiving member being engaged with the power output unit to receive a driving force;

wherein the wheel hub comprises a hollow cylinder portion accommodating the power output unit;

wherein the power receiving member includes a fixing protrusion, the fixing protrusion is engaged with the recessed portion of the power output unit to receive the driving force;

wherein the power receiving unit further comprises a bias part, the bias part applies a bias force to drive the power output unit to move to engage with the fixing protrusion.

9. The power receiving unit according to claim 8, wherein:

the power receiving member further includes a notch, which provides a swinging space for the power output unit.

10. The power receiving unit according to claim 9, wherein:

the bias part is disposed on a side where the notch is located.

11. The power receiving unit according to claim 9, wherein:

one side of the bias part is in contact with the power receiving unit, and the other side of the bias part is disposed in the notch of the power receiving unit.

12. The power receiving unit according to claim 8, wherein:

the bias part is mounted on an inner wall of the wheel hub.

13. The power receiving unit according to claim 8, wherein:

the bias part is an elastic part.

14. The power receiving unit according to claim 8, wherein:

a guide bevel is formed on an end of the fixing protrusion.

* * * * *